US006859631B2

(12) United States Patent
Suzumi et al.

(10) Patent No.: US 6,859,631 B2
(45) Date of Patent: Feb. 22, 2005

(54) IMAGE FORMING APPARATUS AND IMAGE FORMING METHOD

(75) Inventors: Masahiko Suzumi, Shizuoka (JP); Toshio Miyamoto, Shizuoka (JP); Koji Nihonyanagi, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 85 days.

(21) Appl. No.: 10/648,284

(22) Filed: Aug. 27, 2003

(65) Prior Publication Data

US 2004/0042808 A1 Mar. 4, 2004

(30) Foreign Application Priority Data

Aug. 30, 2002 (JP) ..... 2002-255898

(51) Int. Cl.[7] ..... G03G 15/16
(52) U.S. Cl. ..... 399/66
(58) Field of Search ..... 399/45, 66, 85, 399/313, 314, 388

(56) References Cited

U.S. PATENT DOCUMENTS 5,010,370 A 4/1991 Araya et al.
5,521,683 A 5/1996 Miyamoto et al.
5,659,840 A 8/1997 Miyamoto et al. ..... 399/55
5,732,314 A 3/1998 Tsukida et al. ..... 399/302
6,356,732 B1 3/2002 Watanabe et al. ..... 399/299
6,564,020 B2 5/2003 Kuribayashi et al. ..... 399/45
6,654,570 B2 * 11/2003 Kato ..... 399/66

FOREIGN PATENT DOCUMENTS

JP 10-78712 3/1998
JP 2000-227745 8/2000

* cited by examiner

*Primary Examiner*—Hoang X Ngo
(74) *Attorney, Agent, or Firm*—Fitzpatrick, Cella, Harper & Scinto

(57) ABSTRACT

A switching timing condition for controlling the switching timing from first transfer bias during a non-transfer process to second transfer bias during a transfer process is recognized, and the switching timing of the transfer bias from the non-transfer process to the transfer process is switched according to the content of the recognized switching timing condition.

28 Claims, 11 Drawing Sheets

IMAGE FORMING APPARATUS AND IMAGE FORMING METHOD

This application claims priority from Japanese Patent Application No. 2002-255898 filed Aug. 30, 2002, which is incorporated hereinto by reference.

BACKGROUND OF THE INVENTION

1. Field of the Invention

The present invention relates to an image forming apparatus.

2. Description of the Related Art

In a conventional image forming apparatus, as a transfer apparatus for electrostatically transferring a toner image on an image carrier onto a printing member, a corona transfer apparatus using corona discharge, a roller transfer apparatus that applies a transfer bias opposite in polarity to a toner onto a conductive elastic roller (i.e. a transfer roller) and electrostatically transfers the toner to a recording material, and a belt transfer apparatus that electrostatically adsorbs a printing member onto a belt-shaped body of rotation and transfers a toner image onto the printing member, etc. are widely used.

In the above mentioned transfer apparatus, the roller transfer apparatus is widely used in recent years, because little ozone can be produced, and the configuration of the image forming apparatus can be simplified in that a transfer roller can also be used as a carrying roller for transporting a printing member.

Transfer bias control (i.e. voltage control) in a roller transfer apparatus will be explained below.

FIG. 11 is a timing chart showing transfer bias control.

In FIG. 11, solid line below shows the magnitude of transfer bias (i.e. voltage) at a transfer position that a toner image is transferred onto a printing member, and a rectangle above shows a position of the printing member. In FIG. 11, a horizontal direction from left to right shows a timing axis.

In FIG. 11, an image forming apparatus is on standby and starts to apply transfer bias to a transfer roller in response to receive such a command showing forming an image from an external apparatus, such as a host computer, and then becomes a state of being capable of forming an image.

However, the start of applying transfer bias to the transfer roller is performed during initial rotation for rotating a photosensitive drum so that surface voltage of the photosensitive drum being on standby remains a constant value.

Then, the image forming apparatus, as an object of applying suitable transfer bias (i.e. voltage) to a transfer roller 5 (see FIG. 1 stated below), controls transfer bias applied to a transfer roller 5 so as to become a predetermined electric current value from an electric current value flowed into a photosensitive drum (i.e. an image carrier) 1 (see FIG. 1 stated below) from a transfer roller 5.

Further, the image forming apparatus determines a transfer bias $V_t$ in the case of transferring a toner image onto the printing member on condition that a transfer bias value for application is set to $V_{to}$ when an electric current value flowed into a transfer roller 5 becomes a predetermined constant electric current value. However, $V_{to}$ is 300 $V_{DC}$ to +4.5 $KV_{DC}$ and $V_t$ is approximately +500 $V_{DC}$ to +6.0 $KV_{DC}$.

In the image forming apparatus, transfer bias (i.e. voltage) applied to the transfer roller 5 is set to $V_{to}$ until the tip of the printing member P reaches to the transfer position.

Then, transfer bias is changed from $V_{to}$ to $V_t$ at the timing that the tip of the printing member P reaches the transfer position. This switch timing is switched a little earlier than the timing that the tip of the printing member reaches to the transfer position taking into account a rising characteristic (i.e. a time required from the state of non-applied voltage to applying constant voltage) of a power supply applying transfer bias.

In FIG. 11, the switch timing is switched 30 msec before the timing that the tip of the printing member reaches to the transfer position. However, generally, the switch timing is approximately 10 to 200 ms taking into consideration the rising characteristic of the power supply as well as variation in tolerance on the manufacturing stage of the power supply.

The image forming apparatus changes the transfer bias from $V_{to}$ to $V_t$. Thus, the transfer bias is set to $V_t$ when the printing member P is passing through the transfer position (i.e. during transfer period) and is set to $V_{to}$ after a rear end of the printing member P is passing through the transfer position. The timing that transfer bias is switched from $V_t$ to $V_{to}$ is equal to the timing that the rear end of the printing member P is passing through the transfer position.

The above-mentioned operation allows the toner image on the photosensitive drum to be transferred onto the printing member P with an optimum transfer bias (i.e. voltage) according to variation in resistance of the transfer roller due to variation in the environment i.e., the operating environment, (such as temperature, humidity) including the image forming apparatus and due to variation in usage of the transfer roller.

In the above operation of the image forming apparatus, the switch timing is set a little earlier (see 30 msec in FIG. 11) than the timing that the tip of the printing member reaches the transfer position taking into account such a variation in the rising characteristic of a power supply applying transfer bias. Thus, larger bias (i.e. voltage) than $V_{to}$ is applied to the transfer roller 5 after the transfer bias is switched from $V_{to}$ to $V_t$ until the tip of the printing member P reaches the transfer nip position.

As mentioned above, the image forming apparatus applies the transfer roller 5 to the transfer bias in positive polarity and thus applies directly the transfer bias in positive polarity onto the surface of the photosensitive drum 1 when the printing member P is not positioned at the transfer position.

On the other hand, after the photosensitive drum 1 is passing through the transfer position, the image forming apparatus charges the surface of the photosensitive drum 1 with constant voltage in negative polarity, thereby uniforming voltage on the surface of the photosensitive drum 1 and forming a toner image with a desired density.

However, if the voltage of the transfer bias in positive polarity applied directly to the photosensitive drum 1 is a larger valve, the subsequent charging process occurs a problem (so-called drum memory) that the voltage on the surface of the photosensitive drum 1 cannot be made uniform. Due to drum memory, the voltage on the surface of the photosensitive drum 1 cannot be made uniform in the first charging process, resulting in the difference of density of the toner image the next rotational forming process and causing a notable image defect especially in the case of a half-tone image.

Further, when switch timing that the transfer bias is switched from $V_{to}$ to $V_t$ is slowed down to prevent the drum memory, a problem occurs on condition that the transfer bias $V_t$ is a large value and the required time for switching the transfer bias is a longer time.

That is, in the case of applying the transfer bias with high voltage, such as the transfer bias $V_t$ applied onto printing member P with high resistance, the transfer bias $V_t$ applied onto the second side of printing member P for double-side printing or the transfer bias $V_t$ applied to low temperature/low humidity environment, etc., a transfer defect occurs due to lower transfer bias at the tip of printing member P.

As described above, in the usage condition, such as the type of printing member P, image pattern (density, printing dot rate, etc.) of a toner image formed on printing member P or environment including the image forming apparatus, etc., it is very difficult to prevent the drum memory as well as a transfer defect at the tip of printing member P.

SUMMARY OF THE INVENTION

Taking account of the mentioned problems above, the object of the present invention is to provide a revised image forming apparatus.

Further, it is an object of the present invention to provide an image forming apparatus and image forming method capable of preventing drum memory and a transfer defect at the tip of the paper, according to usage conditions such as the type of paper, an image pattern and usage environment, thereby improving image quality due to printing.

In the first aspect of the present invention, there is provided an image forming apparatus, comprising:

an image carrier for holding a toner image, a transfer member for transferring the toner image formed on the image carrier onto a printing member, a voltage application portion for applying voltage to the transfer member, the portion switching the voltage from first voltage to second voltage that is greater than the first voltage so as to transfer the toner image onto the printing member at a transfer nip position that the image carrier is confronted with the transfer member, a mode setting portion for setting a plurality of modes, and a voltage setting portion for setting the voltage, the portion setting the second voltage of a different value according to the mode set by the mode setting portion, wherein the voltage application portion switches the voltage from the first voltage to the second voltage at first timing before a tip of the printing member reaches the transfer nip position when the set mode by the mode setting portion is a first mode, and switches the voltage from the first voltage to the second voltage at second timing that is later than the first timing when the set mode by the mode setting portion is a second mode.

In the second aspect of the present invention, there is provided an image forming apparatus, comprising:

an image carrier for holding a toner image, a transfer member for transferring the toner image formed on the image carrier onto a printing member, a voltage application portion for applying voltage to the transfer member, the portion switching the voltage from first voltage to second voltage that is greater than the first voltage so as to transfer the toner image onto the printing member at a transfer nip position that the image carrier is confronted with the transfer member, and a current detecting portion for detecting electric current that flows to the transfer member, wherein the voltage setting portion sets the first voltage according to voltage applied by the voltage application portion so that the electric current detected by the current detecting portion remains constant value during a non-transfer process that the toner image is not transferred onto the printing member, and wherein the voltage application portion switches the voltage from the first voltage to the second voltage at first timing before a tip of the printing member reaches the transfer nip position when the first voltage is over predetermined voltage, and switches the voltage from the first voltage to the second voltage at second timing that is later than the first timing when the first voltage is smaller than predetermined voltage.

In the third aspect of the present invention, there is provided an image forming apparatus, comprising:

an image carrier for holding a toner image, a transfer member for transferring the toner image formed on the image carrier onto a printing member, a voltage application portion for applying voltage to the transfer member, the portion switching the voltage from first voltage to second voltage that is greater than the first voltage so as to transfer the toner image onto the printing member at a transfer nip position that the image carrier is confronted with the transfer member, and a reverse transporting portion for reversing and transporting the printing member to the transfer nip portion so as to transfer the toner image onto a second surface after transferring the toner image onto a first surface of the printing member, wherein the voltage application portion switches the voltage from the first voltage to the second voltage at first timing before a tip of the printing member reaches the transfer nip position when the toner image is transferred onto the second surface, and switches the voltage from the first voltage to the second voltage at second timing that is later than the first timing when the toner image is transferred onto the first surface.

In the fourth aspect of the present invention, there is provided an image forming apparatus, comprising:

an image carrier for holding a toner image, a transfer member for transferring the toner image formed on the image carrier onto a printing member, a voltage application portion for applying voltage to the transfer member, the portion switching the voltage from first voltage to second voltage that is greater than the first voltage so as to transfer the toner image onto the printing member at a transfer nip position that the image carrier is confronted with the transfer member, and a voltage setting portion for setting the second voltage, wherein the voltage application portion, according to the second voltage set by the voltage setting portion, determines the timing for switching the voltage from the first voltage to the second voltage based on either first timing before a tip of the printing member reaches the transfer nip position or second timing that is later than the first timing.

The above and other objects, effects, features and advantages of the present invention will become more apparent from the following description of embodiments thereof taken in conjunction with the accompanying drawings.

DETAILED DESCRIPTION OF PREFERRED EMBODIMENTS

With reference to the attached drawings, embodiments of the present invention will be explained in detail below.

[First Embodiment]

A first embodiment of the present invention will be explained referred to FIG. 1 to FIG. 5.

<Apparatus Configuration>

Figure 1:
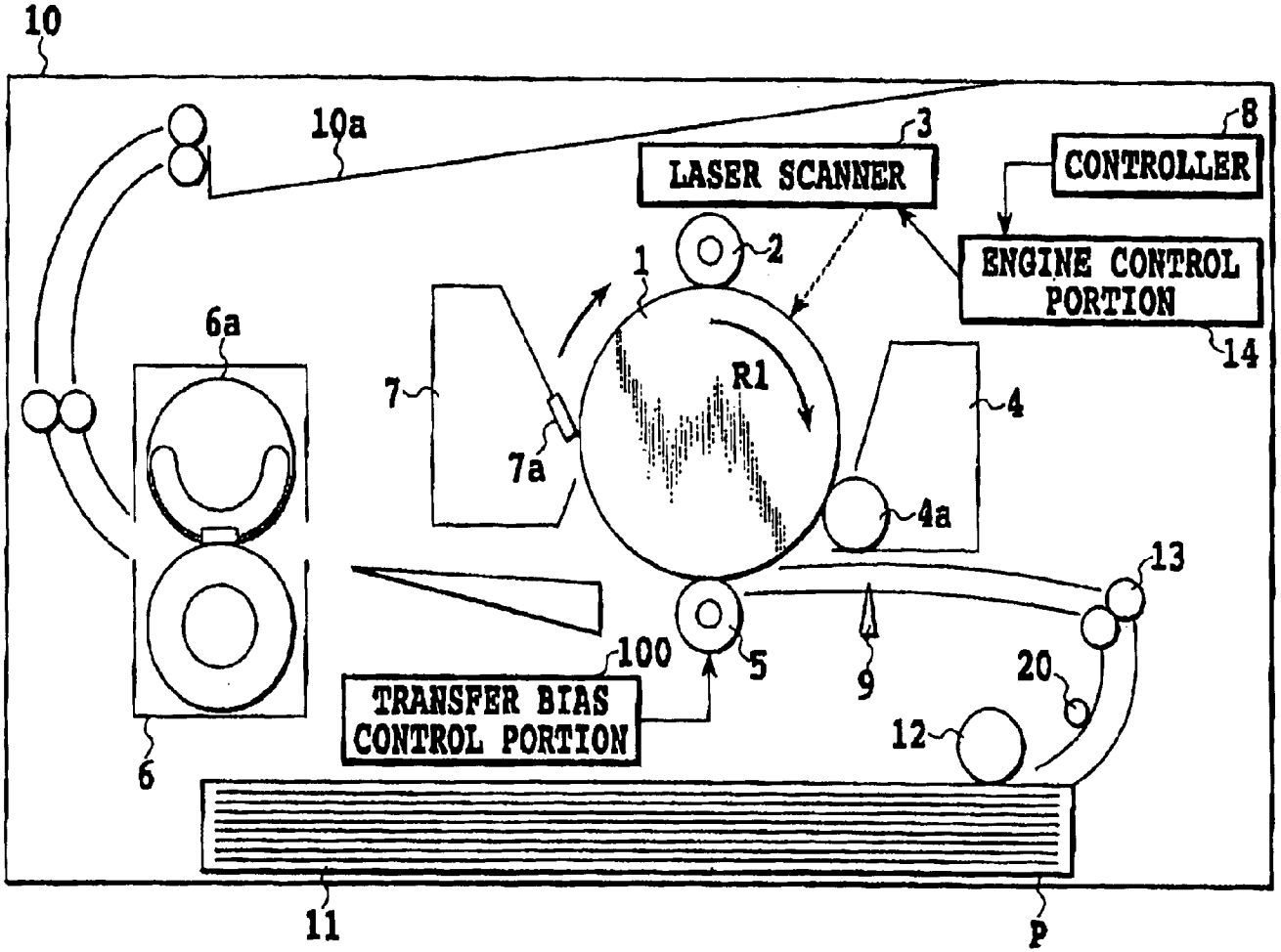
FIG. 1 is a sectional view showing a configuration example of an image forming apparatus according to a first embodiment of the present invention.

FIG. 1 shows a laser beam printer incorporated with a fixing apparatus as an example of an image forming apparatus according to the present invention.

A reference numeral 8 denotes a controller that receives image information and the like transmitted from an external apparatus such as a host computer to the laser beam printer 10 and develops the received image information, and transmits each command to an engine control portion 14.

A reference numeral 14 denotes a engine control portion that controls each portion of the laser beam printer 10 based on each command received from the controller 8.

A reference numeral 100 denotes a transfer bias control portion that controls transfer bias applied to the transfer roller 5.

The laser beam printer 10 includes a drum-shaped electrophotographic photosensitive body (hereinafter referred to as "photosensitive drum") 1.

The photosensitive drum 1 is structured so that a photosensitive material such as OPC (organic optical semiconductor), amorphous selenium and amorphous silicon is formed on a cylinder-shaped drum base made of aluminum or nickel and so forth.

The engine control portion 14 drives a main motor (not shown). The photosensitive drum 1 is rotated by the main motor in the direction indicated by an arrow R1 at a predetermined process speed (peripheral velocity).

The engine control portion 14 drives a charge bias power supply (not shown). The charge bias power supply applies predetermined charge bias (i.e. voltage) to a charge roller (i.e. charge portion) 2 and then the surface of the photosensitive drum 1 is uniformly charged with constant voltage in negative polarity.

The engine control portion 14 drives a laser scanner (i.e. exposure portion) 3. The laser scanner 3 exposes the surface of the photosensitive drum 1 charged with constant voltage in negative polarity by the charge roller 2 due to a laser beam according to the image information, thus forming an electrostatic latent image on the surface of the photosensitive drum 1. That is, the laser scanner 3 performs the ON/OFF-controlled scanning-exposure according to the image information and removes the charge in the exposed section to form the electrostatic latent image on the surface of the photosensitive drum 1.

The engine control portion 14 drives a developing apparatus (i.e. developing portion) 4. The developing apparatus 4 develops the electrostatic latent image formed on the surface of the photosensitive drum 1 due to a toner, and the electrostatic latent image is converted to a visible image. As the developing method, a jumping developing method, two-component developing method, etc., are used. These methods are often used in combination with image exposure and reversal development. Concretely, the engine control portion 14 drives a developing bias power supply (not shown). The developing bias power supply applies predetermined developing bias voltage (i.e. voltage) to a developing roller 4*a*, and the toner stored in the developing portion 4 adheres to the electrostatic latent image on the surf ace of the photosensitive drum 1. Thus, the toner adhered to the electrostatic latent image becomes the visible image as a toner image.

Then, the transfer bias control portion 100 applies transfer bias to the transfer roller 5. The toner image on the photosensitive drum 1 is transferred onto the surface of the printing member P at a transfer nip portion T (i.e. transfer position) that the photosensitive drum 1 is contacted with the transfer roller 5.

However, the engine control portion 14 transports printing member P to the transfer nip portion T at predetermined timing so that the tip of the toner image formed on the photosensitive drum 1 is consistent with the tip of printing member P.

Concretely, the engine control portion 14 drives a paper feed roller 12, a carrying roller 20 and resist roller 13 and so forth. The paper feed roller 12 transports printing member P stored in a paper feed cassette 11 to the transfer nip portion (i.e. transfer member) between the photosensitive drum 1 and transfer roller 5 (transfer member) through the carrying roller 20 and resist roller 13.

When transporting printing member P to the transfer nip portion T, the engine control portion 14 determines the timing that the tip of printing member P reaches the transfer nip portion T based on the timing that the tip of printing member P is detected by a top sensor 9, the position relationship between the position of the top sensor 9 and the position of the transfer nip portion T and the transfer speed of printing member P.

As described above, the transfer bias control portion 100 applies transfer bias $V_t$ to the transfer roller (i.e. transfer portion) 5 at the timing that the tip of printing member P reaches the transfer position, and the toner image on the photosensitive drum 1 is transferred to printing member P.

The engine control portion 14 transports printing member P adhered to the toner image to a fixing apparatus (i.e. fixing portion) 6, and heats and pressurizes printing member P at the fixing nip portion T between a fixing roller 6*a* and a pressurizing roller 6*b* of the fixing apparatus 6.

Then, engine control portion 14 transports printing member P to the top surface of the laser beam printer 10, and thus printing member P is ejected onto an output tray 10*a*.

However, the surface portion of the photosensitive drum 1 passing through the transfer nip portion T keeps a toner (i.e. remaining toner) that is not transferred to printing member P. The remaining toner is erased from the surface of the photosensitive drum 1 by a cleaning blade 7*a* of a cleaning apparatus (i.e. cleaning portion) 7.

By repeating the above-described operation, images can be formed on the surface of printing member P.

However the image forming apparatus of this first embodiment can print images sequentially on printing member P, such as 600 dpi and a printing speed of 45 sheets/min (process speed: approximately 266 mm/sec).

(Transfer Bias Control Portion)

The operation of the transfer bias control portion 100 will be explained in detail.

Figure 2:
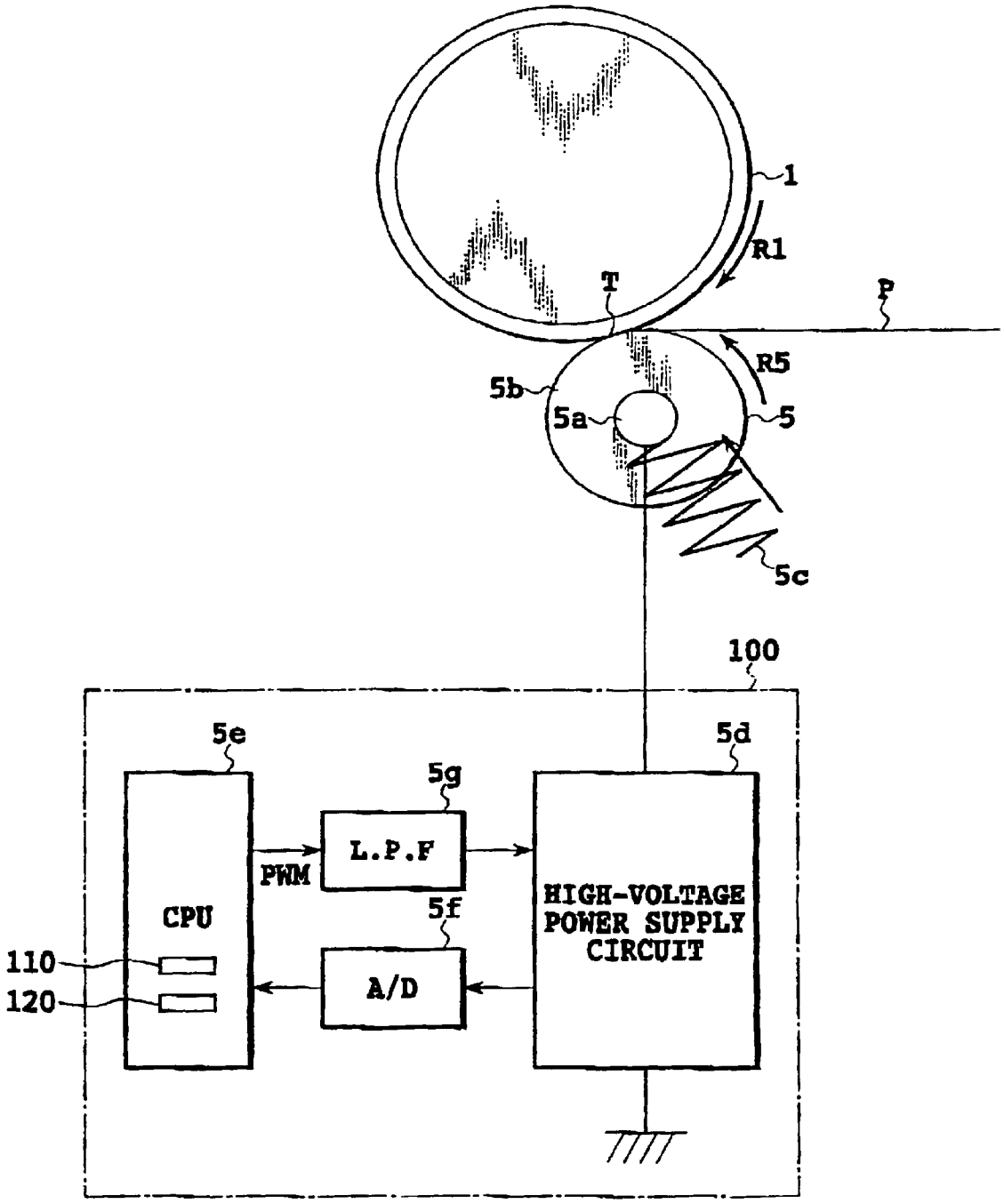
FIG. 2 is a block diagram showing a configuration of a transfer bias control portion.

FIG. 2 is a block diagram showing a configuration example of a transfer bias control portion 100.

The transfer bias control portion 100 applies a first transfer bias to the transfer roller 5 during a non-transfer process that the toner image is not transferred onto printing member P, and applies a second transfer bias that is larger than the first bias to the transfer roller 5 during a transfer process that the toner image is transferred onto printing member P.

This transfer bias control portion 100 is provided with a transfer bias switching recognition portion 110 and a transfer bias switching control portion 120. These portions 110 and 120, for example, can be constructed as a control program, that performs a process as shown FIG. 3 described later, in a CPU 5*e*.

The transfer bias switching recognition portion 110 has a function that recognizes the timing for switching from the first transfer bias during a non-transfer process that the toner image is not transferred onto printing member P to the second transfer bias during a transfer process that the toner image is transferred onto printing member P.

The transfer bias control portion 100 varies the magnitude of transfer bias voltage (i.e. second transfer bias) when the toner image is transferred onto printing member P based on transfer bias mode inputted to the controller 8 from an external apparatus such as a host computer.

The transfer bias switching recognition portion 110 sets transfer bias voltage (i.e. second transfer bias) when the toner image is transferred onto printing member P, and recognizes the timing for switching from the first transfer bias to the second transfer bias according to the set transfer bias mode.

As described later, the transfer bias switching recognition portion 110 recognizes switching timing for transfer bias as first timing before the tip of printing member P reaches the transfer nip portion T when a high mode that transfer bias is high is set, and recognizes switching timing for transfer bias as second timing that is later than first timing when a normal mode or low mode that transfer bias is lower than the high mode is set.

The transfer bias switching control portion 120 has a function for switching the transfer bias from the non-transfer process to the transfer process according to the recognized timing.

In the first embodiment of the present invention, the transfer bias switching control portion 120 switches voltage from the transfer bias $V_{to}$ in the non-transfer process to the transfer bias $V_t$ in the transfer process at the first timing when high mode is set, and switches voltage at second timing that is later than first timing when normal mode or low mode is set.

In FIG. 2, the transfer roller 5 is constructed of an elastic body 5*b*, which is a solid-like body made of EPDM, silicon, NBR or urethane or a sponge-like body structured by foaming the solid-like body, provided on a core metal 5*a* such as iron and stainless steel (i.e. SUS).

The transfer roller 5 has a roller hardness of 20 to 70 degrees (when loaded with Asker Clkg) and a resistance value of the sixth power of 10 (=$10^6$ Ω) to the ninth power of 10 (=$10^9$ Ω), and is pressed against the photosensitive drum 1 by a pressure spring 5*c*. This pressure position is structured as the transfer nip section T between the transfer roller 5 and the photosensitive drum 1.

Furthermore, the transfer roller 5 receives a drive force transmitted from a drive gear (not shown) and its rotation is driven in the direction indicated by the arrow R5.

The CPU 5*e* selectively generates a high level signal and a low level signal, thus outputting a PWM (Pulse Width Modulation) signal with duty ratio according to 256 kinds of 0 to 255. A high-voltage power supply circuit 5*d* applies transfer bias according to voltage DC, which is produced by smoothing the PWM signal due to a low pass filter 5*g*, to the transfer roller 5.

Transfer current that flows from the transfer 5 to the photosensitive drum 1 or printing member P is converted to voltage by a A/D converter 5*f*.

The CPU 5*e* detects voltage inputted from the A/D converter 5*f* and recognizes the transfer current, and then varies the duty ratio of the PWM signal if the recognized transfer current is different from target transfer current.

As mentioned above, CPU 5*e* can control the transfer bias so that the predetermined transfer bias is applied to the transfer roller 5 and the predetermined transfer current is flowed to the transfer roller 5.

However, the transfer bias control portion can set transfer bias value according to 256 kinds of 0 to 255. For example, the PWM signal of '0' is equal to the transfer bias of 0 $V_{DC}$, and the PWM signal of "255" is equal to the transfer bias of 6.0 $KV_{DC}$.

<Apparatus Operation>

Then, the laser beam printer 10 will be explained.

The control of a transfer bias (i.e. voltage) using the transfer bias control portion 100 will be explained referred to FIG. 1 and FIG. 2.

When a print instruction is sent from a controller 8 to an engine control portion 14, the engine control portion 14 starts to feed the printing member P by the paper feed roller 12 and at the same time starts heating up of the fixing apparatus 6 and starts a preparatory rotation (i.e. initial rotation) of the photosensitive drum 1 before image forming step. During the initial rotation, the engine control section 14 applies predetermined charge bias (i.e. voltage) to a charge roller 2 so that the charge roller 2 keeps the surface potential of the photosensitive drum 1 to background (i.e. dark portion) potential $V_d$.

The transfer bias control portion 100 gradually increases the duty ratio of the PWM signal from the CPU 5*e* so that predetermined transfer current Ia flows from the transfer roller 5 to the background (i.e. 'dark portion') of the photosensitive drum 1 and adjusts fine registration of the duty ratio of the PWM signal after the transfer current reaches the target transfer current a, and thereby controls the PWM signal so that constant current flows to the photosensitive drum 1.

However, the duty ratio of the PWM signal, which is set so as to obtain predetermined transfer current Ia, varies according to environments (temperature, humidity, etc.) including the laser beam printer 10.

For example, when the environment is an environment with high temperature and high humidity (i.e. H/H environment), the duty ratio of the PWM signal is lower than that of an environment with normal temperature and normal humidity (i.e. N/N environment) because resistance of the transfer roller 5 decreases.

Further, another example, when the environment is an environment with low temperature and low humidity (i.e. L/L environment), the duty ratio of the PWM signal is higher than that of an environment with normal temperature and normal humidity (i.e. N/N environment) because resistance of the transfer roller 5 increases.

Accordingly, the duty ratio of the PWM signal, which is set so as to obtain predetermined transfer current Ia, is becomes a barometer indicating an environment including the laser beam printer 10.

On the other hand, as the condition that transfer efficiency when the toner image is transferred onto printing member P is constant in spite of the environment including the laser beam printer 10, it is desirable that the transfer current is constant despite differing operating environments.

Then, the transfer bias control portion 100 determines the transfer bias $V_t$ when the toner image is transferred to printing member P based on the duty ratio of the PWM signal that is set so as to obtain predetermined current Ia during initial rotation.

The transfer bias control portion 100 calculates the average value of the duty ratio of the PWM signal that is produced so that predetermined transfer current Ia is flowed to the transfer roller 5 during initial rotation, and memorizes the calculated average value as PWM0 (i.e. transfer bias voltage according to PWM0 is $V_{to}$) in a memory (not shown) of the CPU 5*e*, and further determines the duty ratio PWM1 (i.e. transfer bias voltage according to PWM1 is $V_t$) of the PWM signal for outputting transfer bias (i.e. voltage) $V_t$ during the transfer process.

In the first embodiment, PWM1 is determined based on a control equation shown in a linear equation including PWM0. More specifically, PWM1 is expressed by:

$$PWM1=A\times PWM0+B \quad (1)$$

Where A and B denote constants. There is a linear relationship between the PWM1 value and transfer bias voltage $V_t$. The PWM value is determined and thus the transfer bias voltage $V_t$ is determined.

As described above, the transfer bias control portion 100 determines PWM0 during initial rotation and PWM1 is determined due to the PWM0. Coefficients A and B, for calculating PWM1 due to PWM0, of the equation (1) above always may be used as the same values, but, in the first embodiment, three coefficients can be used according to the types of printing members P.

As mentioned above, the resistance of the transfer roller 5 and the resistance of the printing member P vary according to the environment including the laser beam printer 10. Accordingly, PWM1 is calculated based on PWM0 that is set during initial rotation and then it is possible to cope with the fluctuation of the transfer efficiency due to the environment.

However, there is a wide variety of printing members P that is fed to the transfer nip portion of the laser beam printer 10 and resistance, etc., varies in the same environment. Thus, it is necessary to make the transfer bias $V_t$ different voltage according to the type of the printing member P in order to obtain constant efficiency even with the type of the printing member P.

Then, in the first embodiment, as modes for setting the transfer bias $V_t$, high mode, normal mode and low mode are provided. In each mode, coefficients A and B of the equation (1) are set to different values. For example, a a coefficient A is set to Ah in the high mode and is set to An in the normal mode, and is set to Al in the low mode. Further, a coefficient B is set to Bh in the high mode and is set to Bn in the normal mode, and is set to Bl in the low mode.

Then, the equations (2) to (4) below show the result of the calculations. That is, the equation (2) shows that PWM1h as PWM1 in the high mode is calculated. The equation (3) shows that PWM1n as PWM1 in the normal mode is calculated. The equation (4) shows that PWM11 as PWM1 in the low mode is calculated.

$$PWM1h=Ah\times PWM0+Bh \quad (2)$$

$$PWM1n=An\times PWM0+Bn \quad (3)$$

$$PWM11=Al\times PWM0+Bl \quad (4)$$

Here, the relationship of PWM1h, PWM1n and PWM11 is defined as the equation (5) below.

$$PWM11<PWM1n<PWM1h \quad (5)$$

However, the normal mode is a mode for a plain paper which is generally used. The high mode is a mode that the transfer bias is set higher than the normal mode to present transfer defects from owning over a thick paper or a high resistance, etc. Further, the low mode is a mode that the transfer bias is set low to prevent image defects such as drum memory or transfer penetration, etc., from occurring over a plain paper or half-tone image.

As the transfer bias $V_t$ in each mode, $V_{th}$ is set in the high mode and $V_{tn}$ is set in the normal mode, and $V_{tl}$ is set in the low mode.

(Transfer Bias Control Process)

A specific example of transfer bias control process will be explained referred to FIG. 3 to FIG. 5

Figure 3:
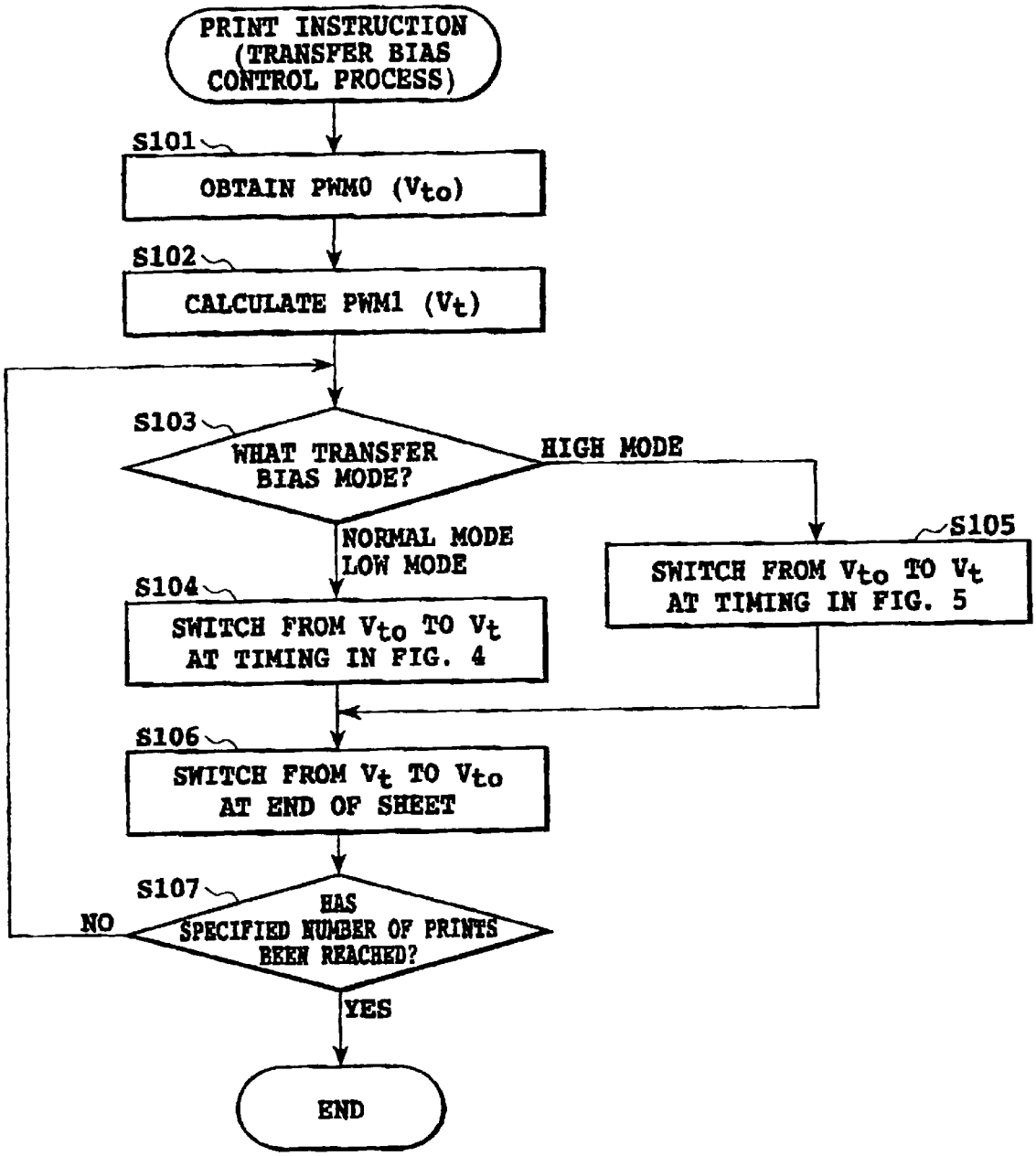
FIG. 3 is a flowchart showing a transfer bias control process.

FIG. 3 is a flowchart showing the transfer bias control process. FIG. 4 is a timing chart of the transfer bias control in a normal mode and a low mode. FIG. 5 is a timing chart of the transfer bias control in a high mode.

First, the transfer bias control portion 100, after processing is started by a print instruction a PWM0 ($V_{to}$) value is obtained (step S101).

The transfer bias control portion 100 selects one among the equations (2) to (4) based on the obtained PWM0 value and the set transfer bias mode, and determines PWM1 ($V_t$) (step S102).

The transfer bias control portion 100 determines the switching timing when PWM0 ($V_{to}$) is switched to PWM1 ($V_t$) based on the set transfer mode, and switches the transfer bias at predetermined timing after the top sensor 9 detects the tip of the printing member P (step S103).

Figure 4:
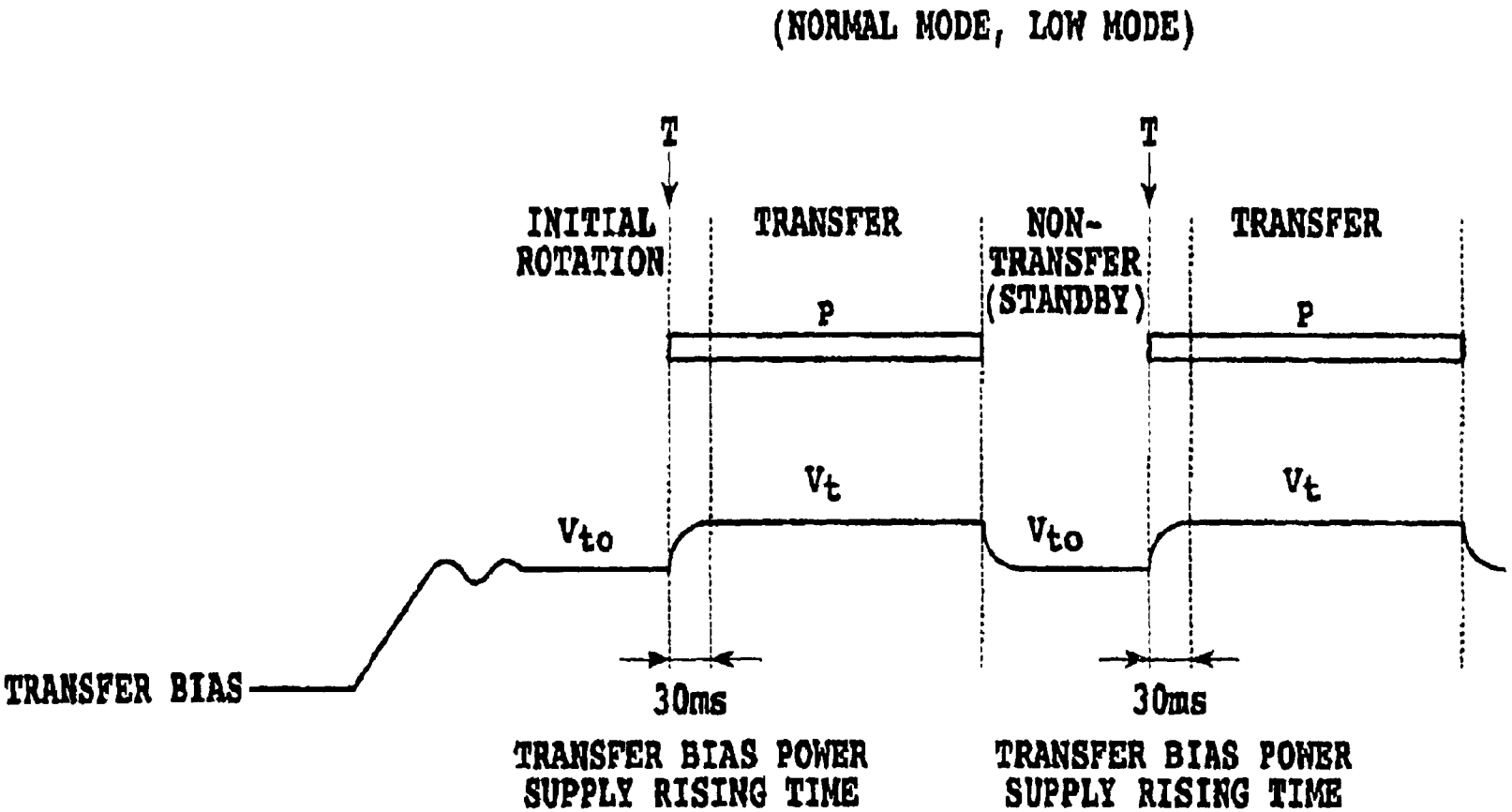
FIG. 4 is a timing chart of transfer bias control according to a normal mode and low mode.

In the first embodiment, as shown in FIG. 4, the transfer bias control portion 100 switches the transfer bias the instant the paper reaches the transfer nip portion T to prevent transfer defects from occurring at the tip of a plain paper in the normal mode and low mode (step S104).

Figure 5:
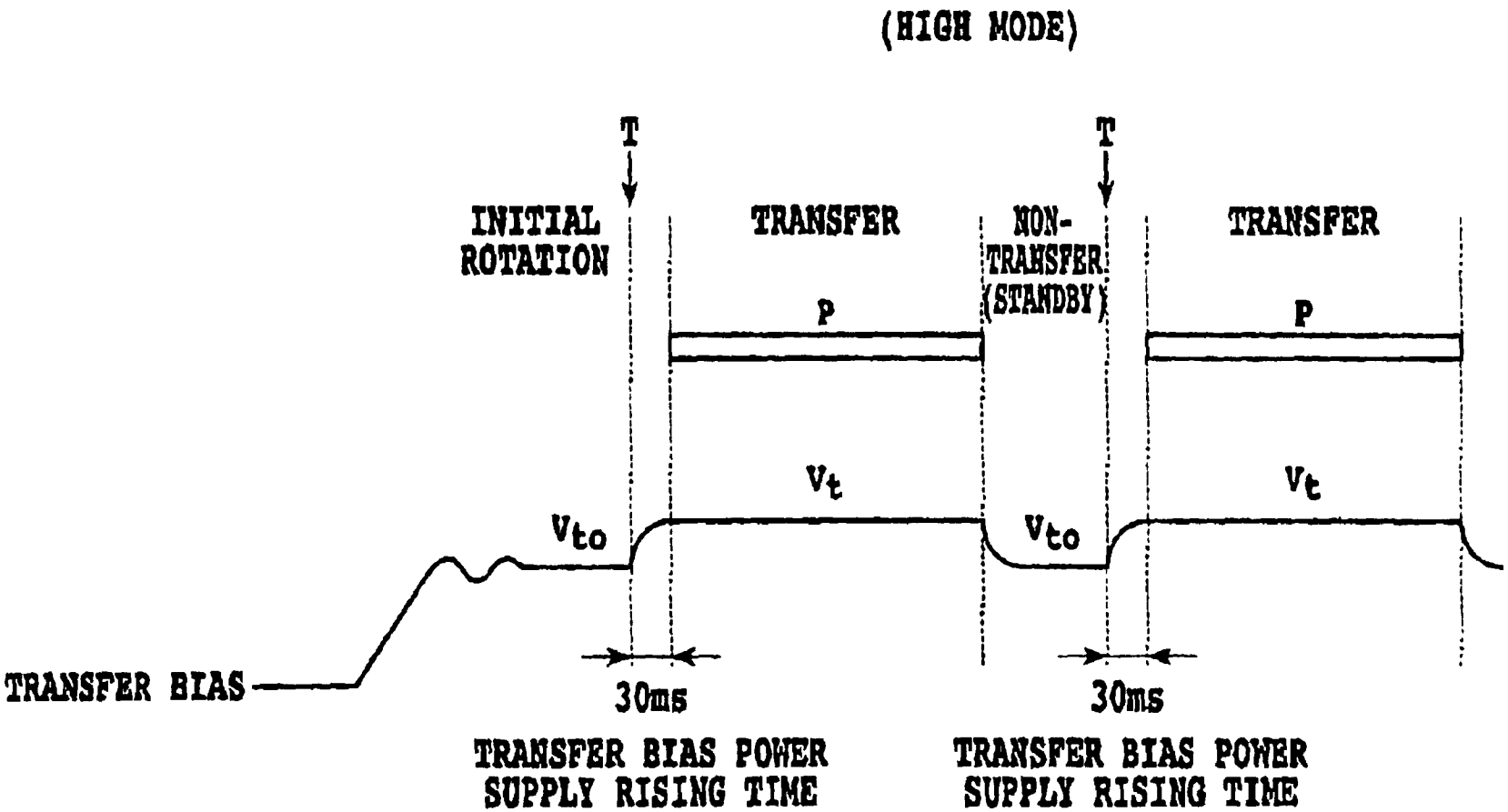
FIG. 5 is a timing chart of transfer bias control according to a high mode.

As shown in FIG. 5, in the high mode, PWM0 ($V_{to}$) is switched to PWM1 ($V_t$) 30 ms (transfer bias power supply rising time) before the paper reaches the transfer nip portion T so that the transfer bias PWM1 ($V_t$) is surely applied from the tip of the paper (step S105).

Then the transfer bras control portion 100 keeps the transfer bias at PWM1 ($V_t$) when the paper is passing and switches the transfer bias from PWM1 ($V_{t1}$) to PWM0 ($V_{to}$) in synchronization with the rear end of the paper. During a non-transfer process, the transfer bias is kept at PWM0 ($V_{to}$)(step S106).

The transfer bias control portion 100 checks whether a specified number of prints is reached or not and printing is continued until the specified number of prints is reached (step S107) by using the same printing procedure.

EXPERIMENT EXAMPLES

Experiment examples of the transfer bias control process will be explained.

Table 1 shows the probability of occurrence concerning the drum memory according to each transfer bias mode under the transfer bias control process of this example.

TABLE 1

| Drum memory according to each transfer bias mode | |
|---|---|
| Transfer bias mode | Plain paper (Xx75 g/m$^2$) |
| High mode | Much generated (x) |
| Normal mode | Little generated (Δ) |
| Low mode | Not generated (○) |

○: Superior Grade,
x: Inferior Grade,
Δ: Middle
Xx denotes Xerox plain paper

As shown in Table 1, it is possible to prevent the drum memory from occurring by switching the transfer bias from PWM0 to PWM1 at the tip of the paper according to the normal mode or low mode. The reason that the probability of occurrence concerning the drum memory of the low mode is a lower level than that of the normal mode is that the transfer bias $V_t$ according to the low mode is smaller than that of the normal mode and thus the low mode has Table 2 shows the probability of occurrence concerning the transfer defect at the tip of the paper according to each transfer bias mode.

TABLE 2

| Transfer defect at the tip of the paper according to each transfer bias mode | | |
|---|---|---|
| Transfer bias mode | Plain paper (Xx75 g/m$^2$) | High-resistance Paper (NB60 g/m$^2$) |
| High mode | Not generated (○) | Not generated (○) |
| High mode *1 | Not generated (○) | Little generated (Δ) |
| Normal mode | Not generated (○) | Little generated (Δ) |
| Low mode | Little generated (Δ) | Much generated (x) |

○: Superior Grade,
x: Inferior Grade,
Δ: Middle

In the high mode *1 of Table 2, switching thing of Voltage from $V_t$ to $V_{to}$ is the same as the normal mode.

In the plain paper according to other modes except the low mode of Table 2, no transfer defeat occurs and thus an image of high quality can be obtained. In the high-resistance paper of Table 2, a little transfer defect occurs in the normal mode, but the image of high quality can be obtained without the occurrence of the transfer defect at the tip of the paper.

Thus, for the user who uses the plain paper, it is possible to provide images of high quality without the drum memory or the transfer defect at the tip of the paper in the normal mode (i.e. default) as the transfer bias mode. Furthermore, for the user who uses the high-resistance paper and worries about the transfer defect at the tip of the paper, it is desirable to select the high mode as the solution of the problem.

According to the first embodiment described above, the transfer bias control portion 100 switches the transfer bias at first timing before a tip of the printing member P reaches the transfer nip portion in the case of the high mode that the transfer bias is set higher on condition that prevention against the transfer defect takes priority over prevention against the adverse effect on the drum memory.

Further, the transfer bias control portion 100 switches the transfer bias at second timing that is later than first timing in the case of the normal mode or the low mode that the transfer bias is set lower than that of the high mode on condition that prevention against the adverse effect on the drum memory takes priority over prevention against the transfer defect.

Therefore, the occurrence of the transfer defect that is easier to generate when the transfer bias is set higher can be prevented, and also the occurrence of the drum memory that is easier to generate when the transfer bias is set lower can be prevented.

[Second Embodiment]

A second embodiment of the present invention will be explained referred to FIG. 6 to FIG. 8, the same parts as the first embodiment described above are assigned the same reference numerals and explanations thereof will be omitted.

In this example, an operating environment is detected by using a temperature characteristic of the resistance value of a transfer roller made of an on conductive material (NBR, etc.), and the control for switching the timing is performed so that the transfer bias is switched from PWM0 ($V_{to}$) to PWM1 ($V_t$) according to the detected operating environment. Other conditions are the same as those of the first embodiment mentioned above.

(Detection of Operating Environment)

As shown in this example, when the transfer roller made of an ion conductive material (NBR, etc.) is used, the PWM0 value as the transfer bias PWM control value can be shown in Table 3 under each environment. Furthermore, the resistance value of the transfer roller 5 of this example is $4\times10^7$ Ω to $8\times10^7$ Ω.

TABLE 3

| PWM0 value under each environment | | | |
|---|---|---|---|
| | H/H environment | N/N environment | L/L environment |
| PWM0 Value | 60 to 70 | 75 to 100 | 105 to 255 |

As shown in Table 3, the transfer roller resistance value varies at a lower lever under high temperature/high humidity environment (H/H environment) and varies at a higher level under low temperature/low humidity environment (L/L environment). Therefore, the PWM0 value decreases under the H/H environment and increases under the L/L environment. Due to this characteristic, it is possible to detect the operating environment.

Figure 6:
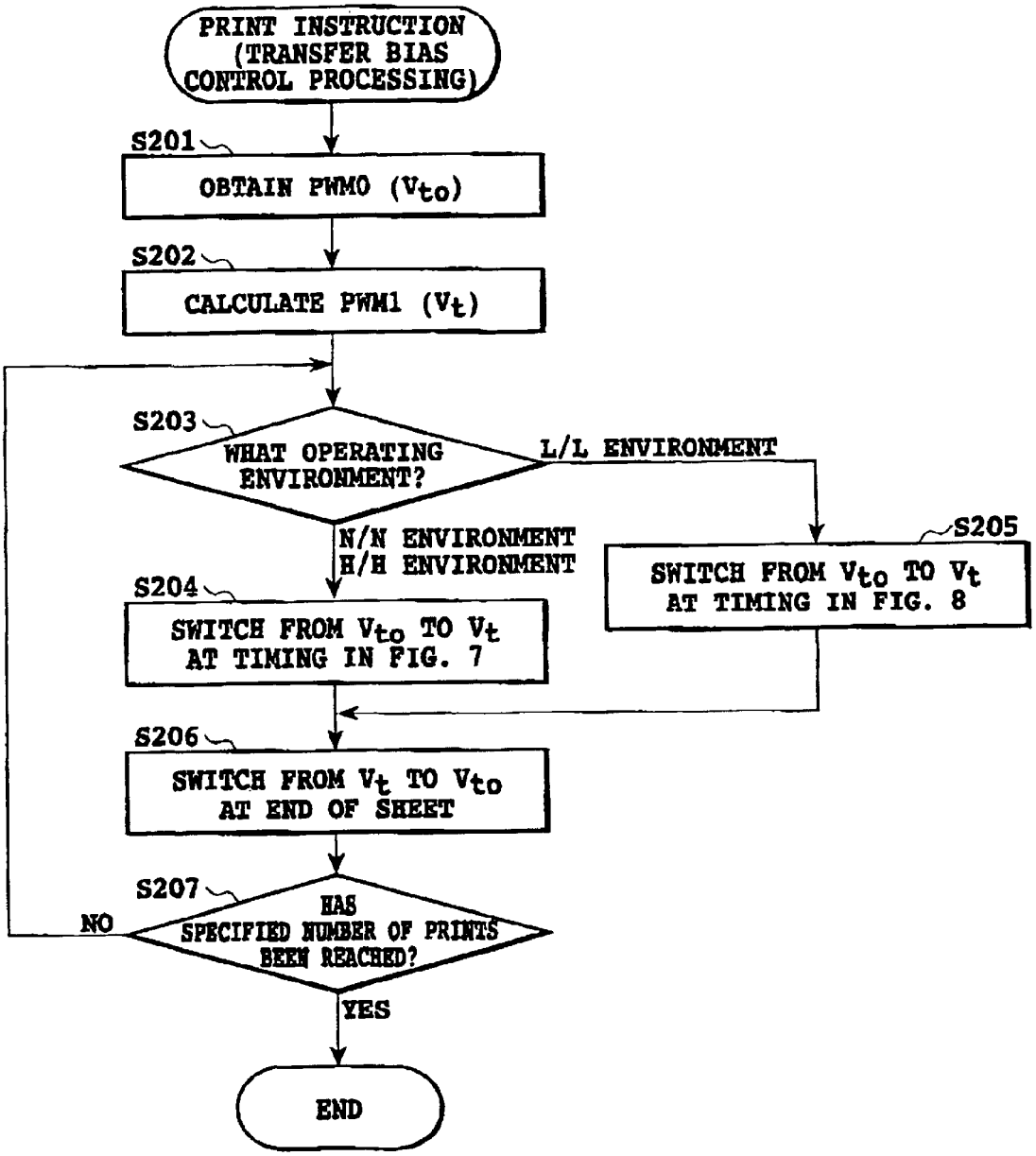
FIG. 6 is a flowchart showing a transfer bias control process according to a second embodiment of the present invention.

However, Table 3 is stored in a memory (not shown) of the CPU 5*e* in the transfer bias control portion 100, and is compared to the PWM0 value is found from step S201 shown in FIG. 6, thereby judging the environment including the laser beam printer 10.

(Transfer Bias Control Process)

A specific example of the transfer bias control process will be explained referred to FIG. 6 to FIG. 8.

FIG. 6 is a flowchart showing the transfer bias control process. FIG. 7 is a timing chart of the transfer bias control under an H/H environment and N/N environment. FIG. 8 is a timing chart of the transfer bias control under an L/L environment.

First, the PWM0 ($V_{to}$) value is found (step S201) and the PWM1 ($V_t$) value is calculated from the determined PWM0 ($V_t$) value (step S202).

Then, the operating environment is detected from the PWM0 ($V_{to}$) value, the switching timing of the transfer bias value is determined and the transfer bias is switched at predetermined timing based on a detection signal of the top sensor (step S203).

Figure 7:
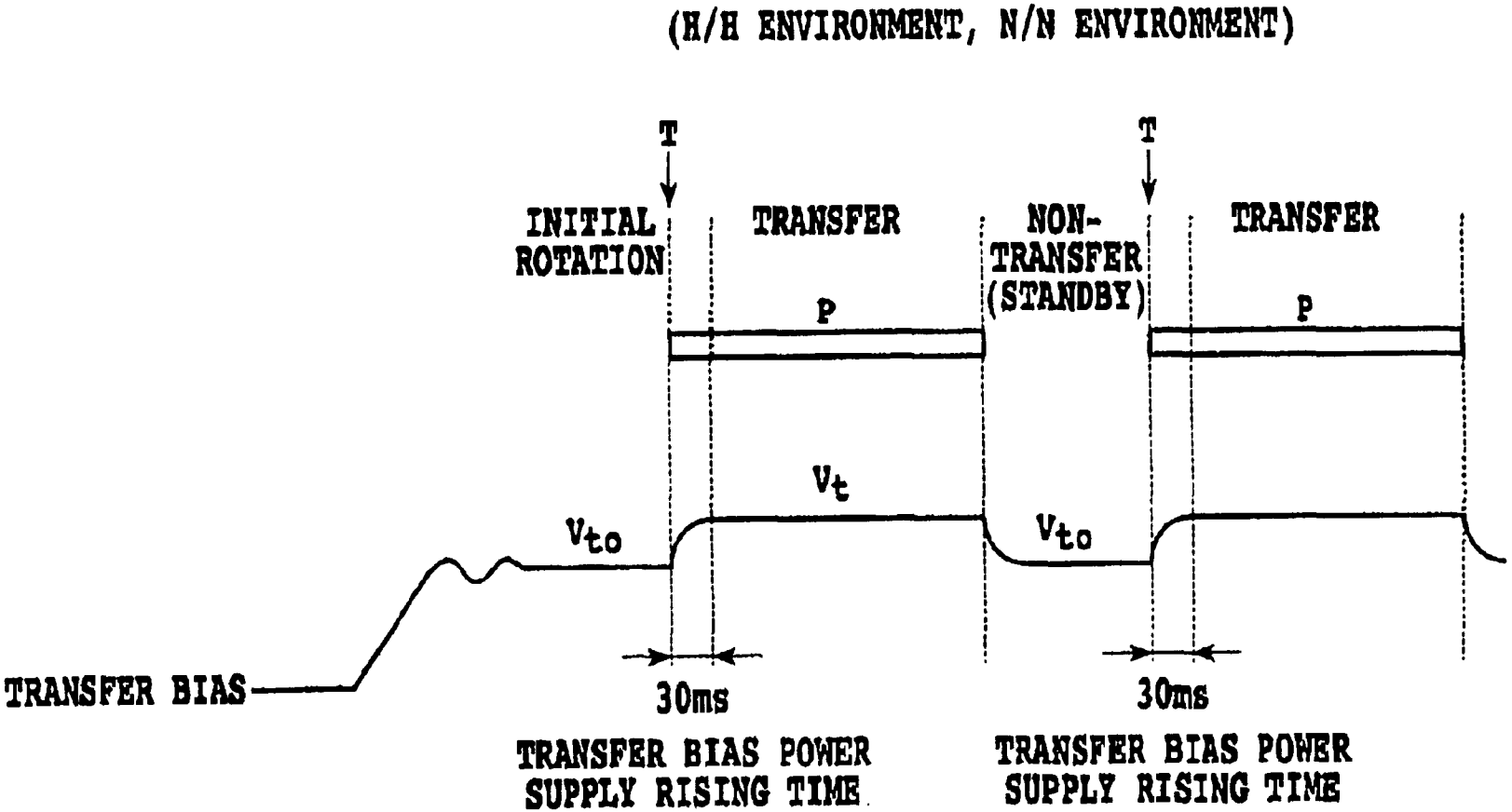
FIG. 7 is a timing chart showing transfer bias control according to H/H environment and N/N environment.

In this example, as shown in FIG. 7 under the H/H environment or the N/N environment that the resistance of the transfer roller 5 and the photosensitive drum 1 is low and the drum memory is easier to occur, the transfer bias is switched from PWM0 ($V_{to}$) to PWM1 ($V_t$) the instant the paper reaches the transfer nip portion T (step S204).

Figure 8:
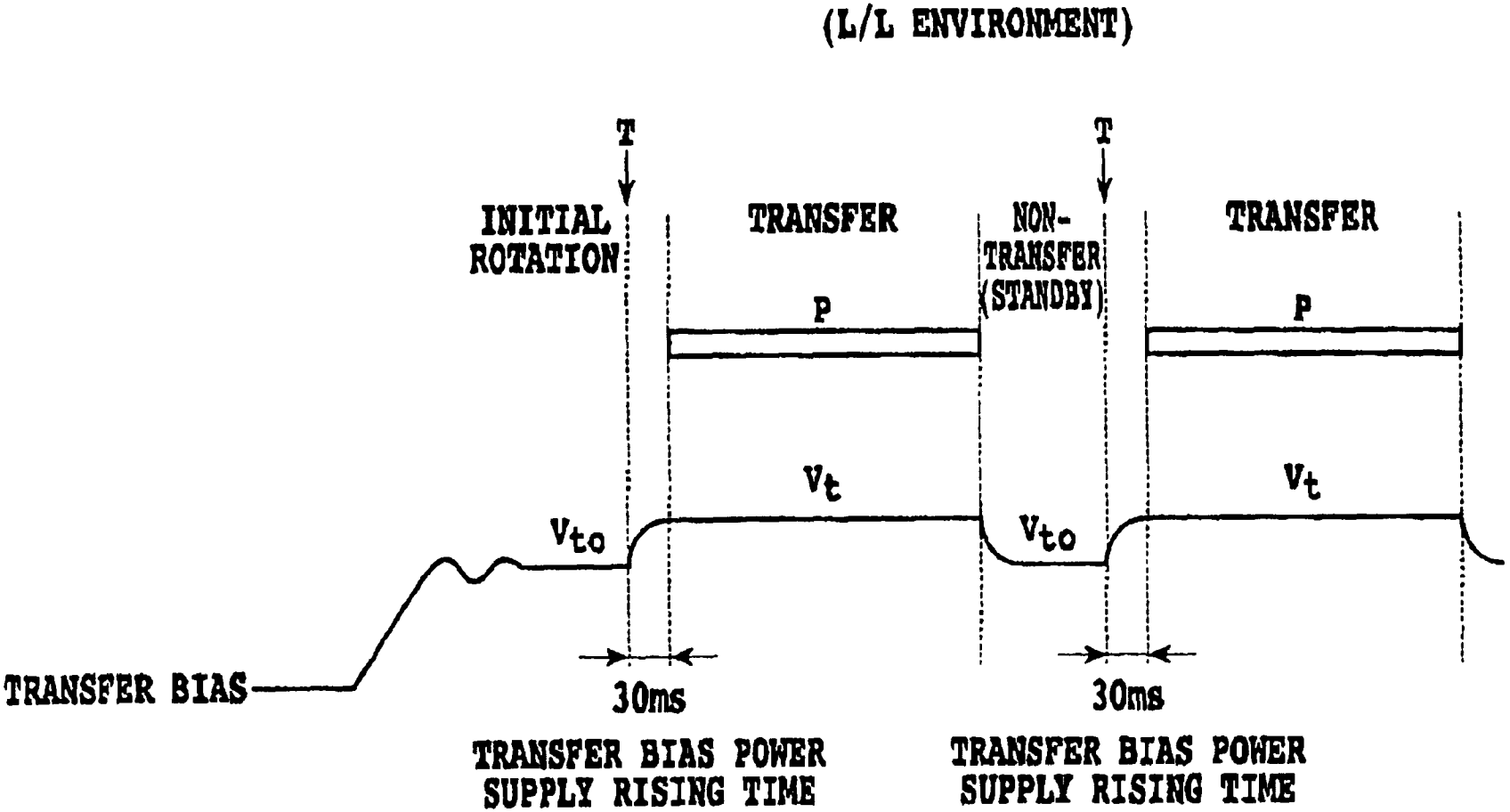
FIG. 8 is a timing chart showing transfer bias control according to L/L environment.

As shown in FIG. 8, under the L/L environment that the resistance of the transfer roller 5 and the paper is high and the transfer defect is easier to occur, the transfer bias is switched 30 ms (i.e. the rising time of the transfer bias power supply) before the paper reaches the transfer nip portion T (step S205).

Then, the transfer bias is kept at PWM1 ($V_t$) when the paper is passing through, the transfer bias is switched from PWM1 ($V_t$) to PWM0 ($V_{to}$) in synchronization with the rear end of the paper and is kept at PWM0 ($V_{to}$) during the time corresponding to a gap between papers (step S206).

Then, it is checked whether the number of prints is reached to a predetermined value or not and printing is continued as the same procedure so as to obtain the predetermined value (step S207).

EXPERIMENT EXAMPLE

An experimental example of the transfer bias control process will be explained.

Table 4 shows the probability of occurrence concerning the drum memory under each environment in the transfer bias control process of this example.

TABLE 4

| | Drum memory under each environment | | |
|---|---|---|---|
| Control Process | H/H environment | N/N environment | L/L environment |
| Conventional | Much generated (x) | Little generated (Δ) | Not generated (○) |
| The present Invention | Not generated (○) | Not generated (○) | Not generated (○) |

○: Superior Grade,
x: Inferior Grade,
Δ: Middle

As shown in Table 4, in the conventional control process, the drum memory normally occurs under normal environment (N/N) or high temperature/high humidity environment (H/H). In the control of this example, drum memory does not occur under the normal environment (N/N) or high temperature/high humidity environment (H/H).

Table 5 shows the probability of occurrence concerning the transfer defect at the tip of the paper under each environment

TABLE 5

| | Transfer defect at the tip of the paper under each environment | | |
|---|---|---|---|
| Control Process | H/H environment | N/N environment | L/L environment |
| Conventional | Not generated (○) | Not generated (○) | Not generated (○) |
| The present invention | Not generated (○) | Not generated (○) | Not generated (○) |

○: Superior Grade,
x: Inferior Grade,
Δ: Middle

As shown in Table 5, in the transfer bias control process of this example, the transfer defect does not occur at the tip of the paper under each environment as the same the conventional control process.

However, in this example, operating environment is detected by the PWM0 value and the switching timing of the transfer bias is changed to the predetermined value based on the operating environment. However, the same effect can be obtained by means of a method for detecting the operating environment based on a temperature/humidity sensor, etc.

As described above, the operating environment is detected and the timing is switched so that the transfer bias is switched from PWM0 ($V_{to}$) to PWM1 ($V_t$) based on the detected information, thereby preventing image defects such as the drum memory and the transfer defect at the tip of the paper.

[Third Embodiment]

A third embodiment of the present invention will be explained referred to FIG. 9 and FIG. 10. The same parts as the first embodiment and the second embodiment described above are assigned the same reference numerals and explanations thereof will be omitted.

In the third embodiment, the switching control of the timing is performed so that the transfer bias is switched from $V_{to}$ to $V_t$ over the first side as well as the second side of the paper during automatic double-side printing. Other conditions are the same as those of the aforementioned embodiments.

In the third embodiment, the control for switching the timing is performed so that the transfer bias is switch from $V_{to}$ to $V_t$ between the first side and the second side during the automatic double-side printing. Other conditions are the same as those of the first embodiment mentioned above.

However, in this third embodiment, when the transfer bias control portion 100 forms an image onto the first side and the second side of the printing member P, the coefficients A and B of the equation (1) become different values between the first side and the second side.

Concretely, the transfer bias control portion 100 calculates PWM1 for applying the transfer bias $V_{t1}$ by using the equation (6) below when forming the image onto the first side of the printing member P, and calculates PWM2 for applying the transfer bias $V_{t2}$ by using the equation (7) when forming the image onto the second site of the printing member P.

$$PWM11=A1\times PWM0+B1 \quad (6)$$

$$PWM12=A2\times PWM0+B2 \quad (7)$$

Here, PWM11 and PWM12 are related to the equation (8) below.

$$PWM11<PWM12 \quad (8)$$

(Transfer Bias Control Process)

A specific example of the transfer bias control process will be explained referred to FIG. 9 and FIG. 10.

Figure 9:
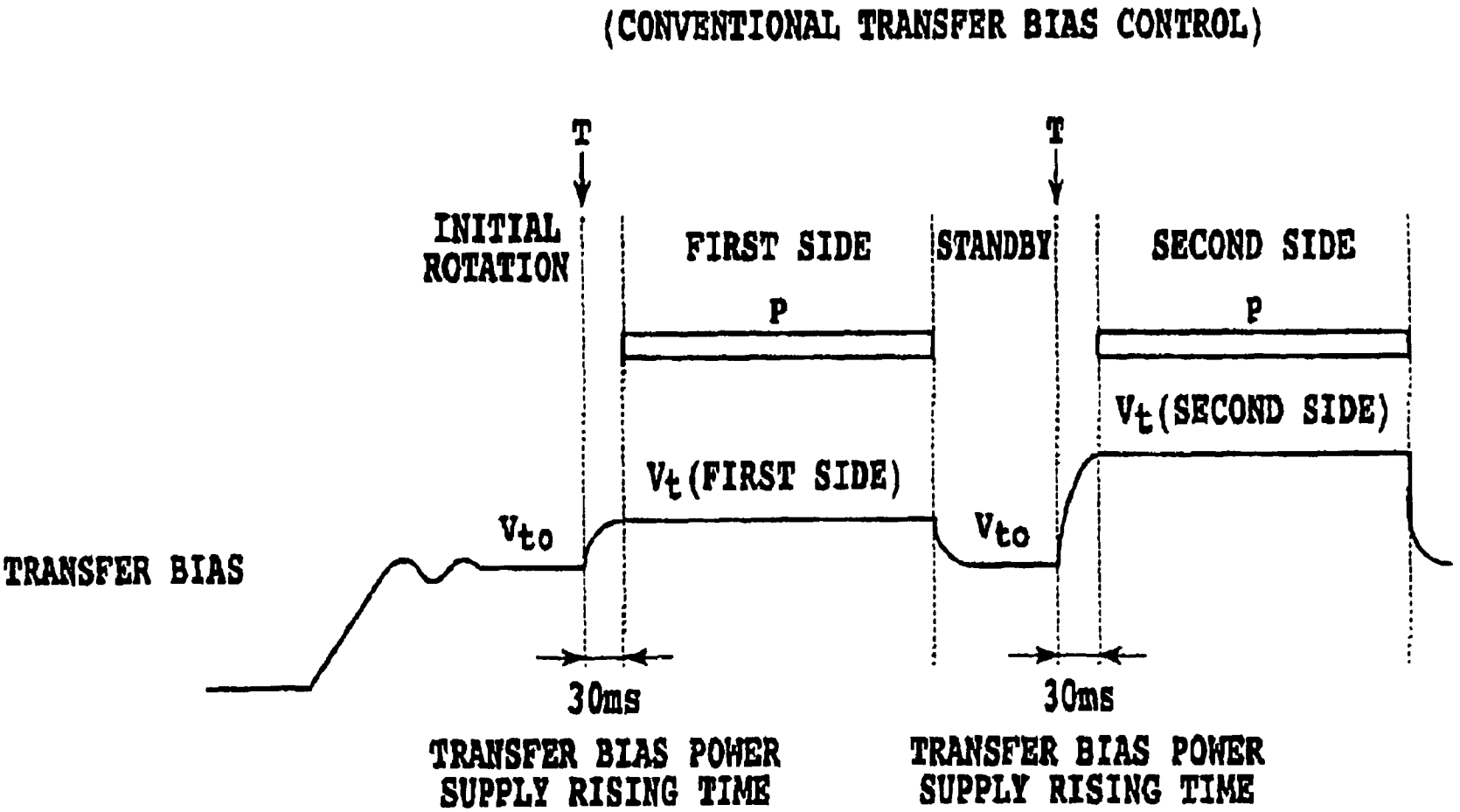
FIG. 9 is a timing chart showing conventional transfer bias control as a comparative example of FIG. 10.
Figure 10:
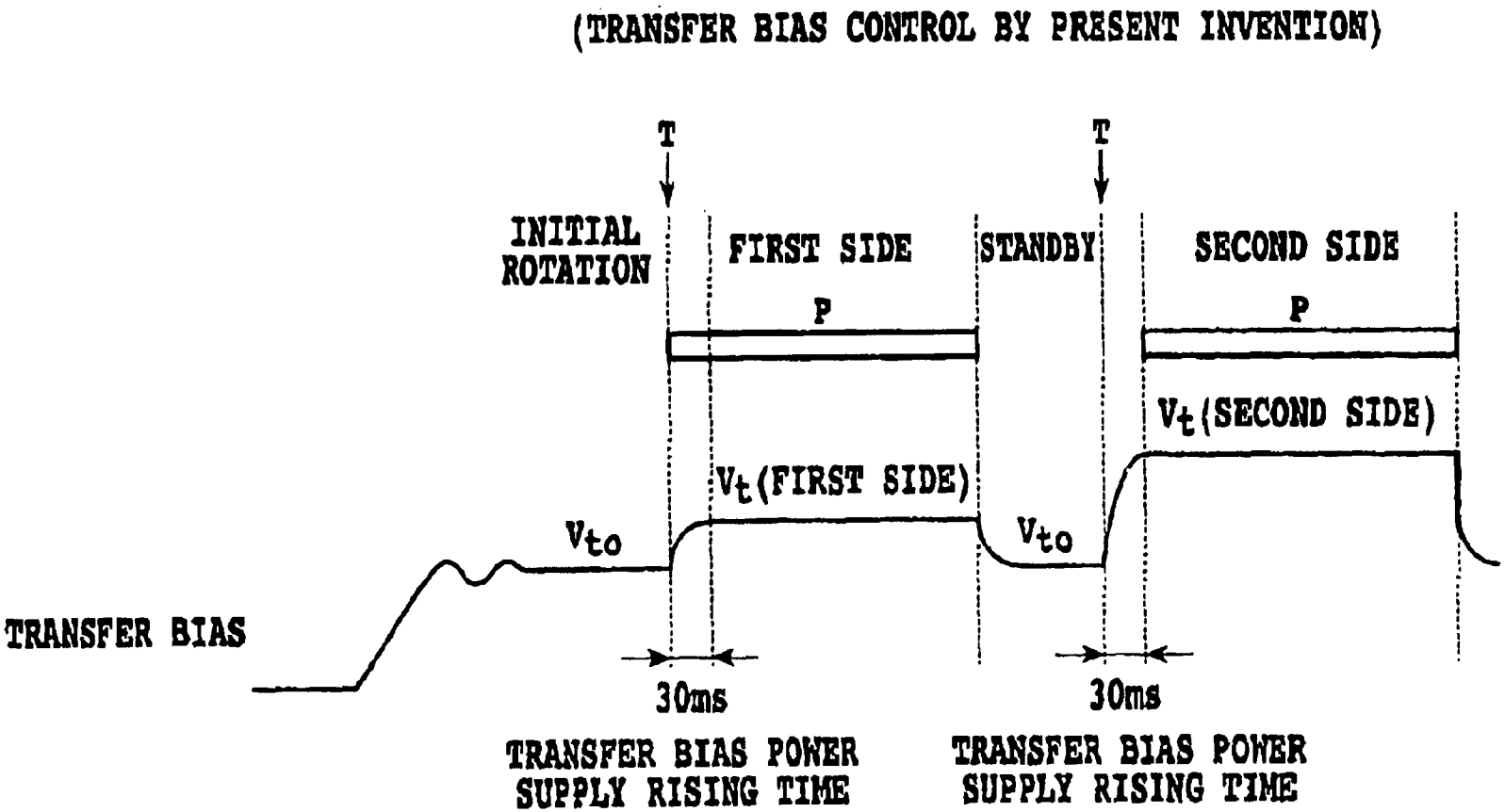
FIG. 10 is a timing chart showing transfer bias control according to a third embodiment of the present invention.
Figure 11:
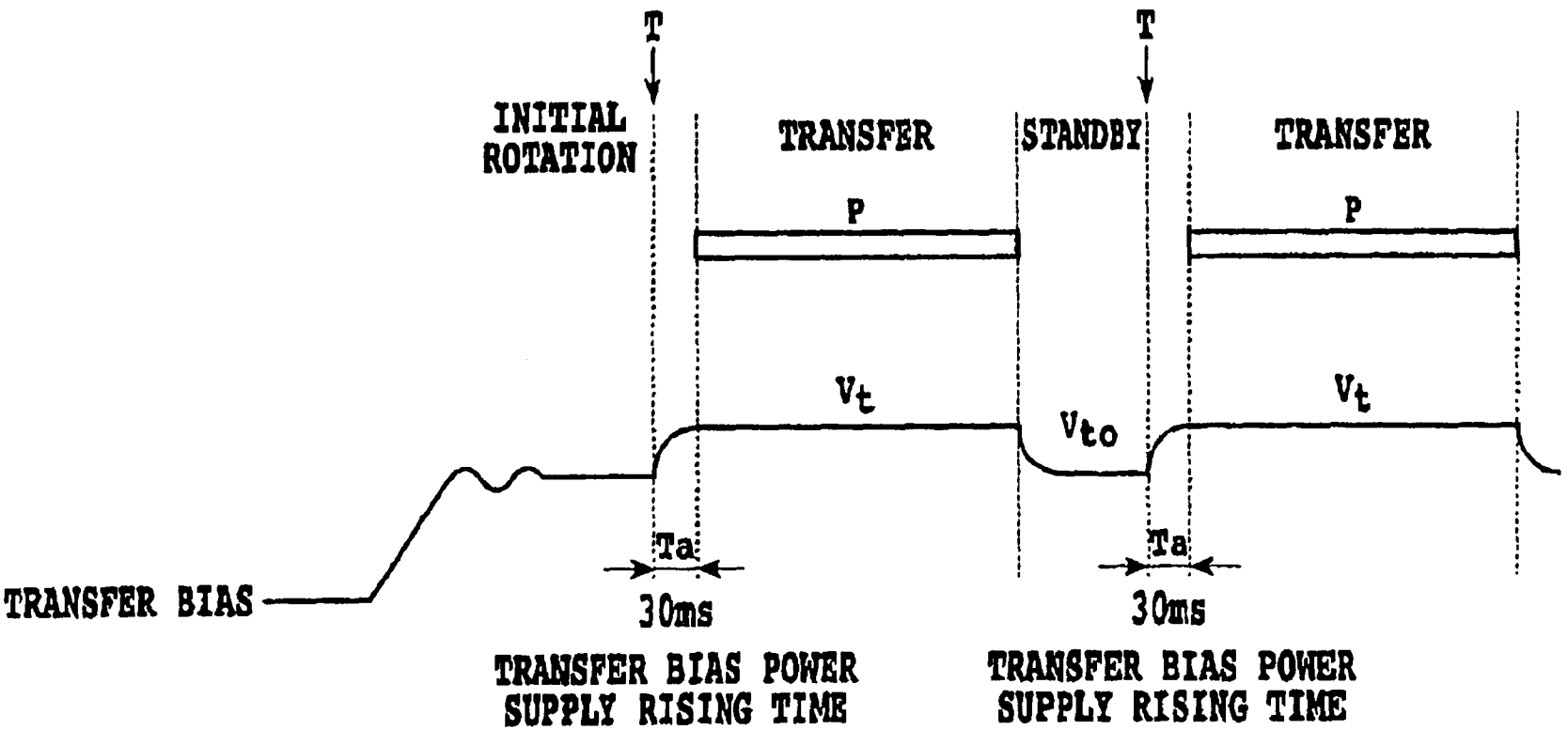
FIG. 11 is a timing chart showing conventional transfer bias control.

FIG. 9 is a timing chart concerning the conventional transfer bias control process shown as a comparative example. FIG. 10 is a timing chart concerning the transfer bias control process according to the present invention.

In the conventional transfer bias control shown in FIG. 9, the timing that the transfer bias is switched from $V_{to}$ to $V_t$ is easier than the timing that the tip of the printing member P reaches the transfer nip portion T concerning a time corresponding to the rising time (approximately 30 ms) of the high voltage power supply circuit (i.e. the transfer bias power supply circuit).

On the contrary, in the transfer bias control process of the third embodiment, the switching timing of the transfer bias for the second side remains the same as that of the conventional control, whereas the switching timing of the transfer bias for the first side is controlled so that it is delayed to an extent that the transfer defect at the tip of the plain paper does not occur.

EXPERIMENT EXAMPLE

An experimental example of the transfer bias control process will be explained.

Table 6 shows the probability of occurrence concerning the drum memory on each side under the transfer bias control of this example.

TABLE 6

| Transfer bias Control | Drum memory on each side: First side | Drum memory on each side: Second side |
|---|---|---|
| Conventional | Little generated (Δ) | Little generated (Δ) |
| The present invention | Not generated (○) | Little generated (Δ) |

○: Superior Grade,
x: Inferior Grade,
Δ: Middle

As shown from Table 6, the drum memory occurs on both the first side and the second side under the conventional control, and the drum memory on the first side can be improved under the control of the present invention.

Table 7 shows the probability of occurrence concerning the transfer defect at the tip of the paper during automatic double-side printing under the control of this example.

TABLE 7

| Transfer bias Control | Transfer defect at the tip of the paper on each side during automatic double-side printing: First side | Second side |
|---|---|---|
| Conventional | Not generated (○) | Not generated (○) |
| The present invention | Not generated (○) | Not generated (○) |

○: Superior Grade,
x: Inferior Grade,
Δ: Middle

In the transfer bias control process of this example, the transfer defect at the tip of the paper does not occur on both the first side and the second side. Thus, the probability of occurrence concerning the transfer defect of the control of the present invention is equivalent to or superior to that of the conventional control.

As described above, by switching the timing so as to switch the transfer bias from $V_{to}$ to $V_t$ between the first side and the second side during the automatic double-side printing, it is possible to completely prevent the transfer defect at the tip of the paper on the second side that the transfer defect is easier to occur, and at the same time it is also possible to prevent the transfer defect at the tip of the paper on the first side due to the drum memory.

Therefore, this allowed the image quality during printing to improve remarkably compared to the conventional transfer bias control.

The present invention may be applied to a system constructed of a plurality of devices (e.g., a host computer, an interface device, a reader, a printer, etc.) or to a single device (e.g., a small image process device such as PDA (Personal Digital Assistant) or a copier and a facsimile apparatus).

Furthermore, it goes without saying that the present invention is also applicable to a case where the present invention is implemented by supplying a program to a system or apparatus. The effects of the present invention can also be attained in that a storage medium storing a program represented by software for implementing the present invention is supplied to a system or apparatus, and a computer (or a CPU or MPU) of the system or apparatus reads and executes program codes stored in the storage medium.

In this case, the program code read from the storage medium themselves realizes the functions of the aforementioned embodiments and then the storage medium storing the program code includes the structure of the present invention.

As such a storage medium for supplying the program codes, a floppy (registered trademark) disk, a hard disk, an optical disk, a magnet-optical disk, a CD-ROM, a CD-R, a magnetic tape, a non-volatile memory card (IC memory card) a ROM (mask ROM, flash EEPROM, etc.) can be used.

Furthermore, it goes without saying that the present invention is applicable to not only a case that program codes read from the computer is executed and the functions of the aforementioned embodiments are realized but also a case that the OS (operating system), etc., operating on the computer performs part of or all the actual process based on instructions of the read program codes and the functions of the aforementioned embodiments are realized based on the process.

It further goes without saying that the present invention is also applicable to a case that program codes read from a storage medium are written to a memory provided for a function expansion board inserted in the computer or a function expansion unfit connected to the computer, and then the CPU, etc., provided for the function expansion board or the function expansion unit performs part of or all the actual process based on instructions of the read program codes and the functions of the aforementioned embodiments are realized based on the process.

As described above, according to the present invention, a switching timing condition for controlling the switching timing from first transfer bias during a non-transfer process to second transfer bias during a transfer process is recognized, and the switching timing of the transfer bias from the non-transfer process to the transfer process is switched according to the content of the recognized switching timing condition, and thus by preliminarily setting the switching timing conditions such as a transfer mode, operating environment, side information on the first side and second side of double-side printing, it is possible to switching on-timing of the transfer bias based on the set content, thereby completely preventing image defects such as the drum memory and the transfer defect at the tip of the paper and considerably improving image quality during a printing process compared to that of the conventional transfer bias control.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

What is claimed is:

1. An image forming apparatus comprising:

an image carrier for holding a toner image;

a transfer member for transferring the toner image from the image carrier at a transfer position;

voltage application means for applying a voltage to a transfer member; and control means for controlling an output of the voltage application means, wherein the control means controls the voltage application means in each of a first mode and a second mode so as to switch the output of the voltage application means from a first voltage value to a second voltage value, wherein the second voltage value is a voltage for transferring the toner image formed on the image carrier, wherein a difference in the first mode between the first voltage value and the second voltage value is larger than a difference in the second mode between the first voltage value and the second voltage value, and wherein a time period of the first mode from a timing of a switching operation controlled by the control means to a timing that a position of the image carrier corresponding to a tip position of a printing member has reached the transfer position is longer than a time period of the second mode from the timing of the switching operation controlled by the control means to a timing that a position of the image carrier corresponding to the tip position of the printing member has reached the transfer position.

2. The image forming apparatus of claim 1, wherein there is no difference in the time period of the second mode from the timing of the switching operation controlled by the control means to the timing that the position of the image carrier corresponding to the tip position of the printing member has reached the transfer position.

3. The image forming apparatus of claim 1, wherein the control means controls the voltage application means so as to apply a bias voltage to the transfer member at the transfer position during a non-transferring time period to detect a resistance value of the transfer position.

4. The image forming apparatus of claim 3, wherein the control means controls the voltage application means so as to set the second voltage according to a detected resistance value.

5. The image forming apparatus of claim 3, wherein an operating environment in a main body of the apparatus is detected based a detected resistance value at the transfer position.

6. The image forming apparatus of claim 5, wherein the mode is selected according to a detected operating environment.

7. The image forming apparatus of claim 3, wherein the mode is selected and the second voltage is set according to a detected resistance value.

8. The image forming apparatus in any one of claims 1 through 5, wherein the mode is selected according to a type of the printing member.

9. An image forming apparatus comprising:

an image carrier for holding a toner image;

a transfer member for transferring the toner image from the image carrier onto a printing member;

voltage application means for applying a voltage to the transfer member; and control means for controlling an output outputted from the voltage application means, wherein the control means controls the voltage application means in each of a first mode and a second mode so as to switch an output of the voltage application means from a first voltage value to a second voltage value, wherein the second voltage value is a voltage for transferring the toner image formed on the image carrier, wherein the first mode is a mode such that the control mans controls the voltage application means so as to switch the output before a printing member is transported to a transfer position between the image carrier and the transfer member, and wherein the second mode is a mode such that the control means controls the voltage application means so as to switch the output of the voltage application means when the printing member is transported to the transfer position between the image carrier and the transfer member.

10. The image forming apparatus of claim 9, wherein the mode is selected according to a type of the printing member.

11. The image forming apparatus of claim 10, wherein the first mode is selected when the printing member is a thick paper, and the second mode is selected when the printing member is a plain paper.

12. The image forming apparatus of claim 9, wherein the toner image is transferred onto both sides of the printing member, and a mode at a first side of the printing member is different from a mode at a second side of the printing member when forming an image.

13. The image forming apparatus of claim 9, wherein the control means controls the voltage application means so as to apply a bias voltage to the transfer member at the transfer position during a non-transferring time period to detect a resistance value of the transfer position.

14. The image forming apparatus of claim 13, wherein the control means controls the voltage application means so as to set the second voltage according to a detected resistance value.

15. The image forming apparatus of claim 13, wherein an operating environment in a main body of the apparatus is detected based on a detected resistance value.

16. The image forming apparatus of claim 15, wherein the mode is selected according to a detected operating environment in the main body of the apparatus.

17. The image forming apparatus of claim 13, wherein the mode is selected and the second voltage is set according to a detected resistance value.

18. An image forming apparatus comprising:

an image carrier for holding a toner image;

a transfer member for transferring the toner image from the image carrier;

voltage application means for applying a voltage to a transfer member; and control means for controlling an output of the voltage application means, wherein the control means controls the voltage application means in each of a first mode and a second mode so as to switch the output of the voltage application means from a first voltage value to a second voltage value, wherein the second voltage value is a voltage for transferring the toner image formed on the image carrier, wherein a difference in the first mode between the first voltage value and the second voltage value is larger than a difference in the second mode between the first voltage value and the second voltage value, and wherein a switching operation of the first mode controlled by the control means occurs earlier in an image forming operation than a switching operation of the second mode enabled by the control means.

19. The image forming apparatus of claim 18, wherein the toner image is transferred from the image carrier at a transfer position located between the image carrier and the transfer member, and wherein a time period of the first mode from a timing that a predetermined position of the image carrier has been reached to the transfer position to a timing of a switching operation controlled by the control means is shorter than a time period of the second mode from a timing that the predetermined position of the image carrier has been reached the transfer position to the timing of the switching operation controlled by the control means.

20. The image forming apparatus of claim 18, wherein the timing of the switching operation controlled by the control means in the second mode occurs earlier in an image forming operation than a timing that a position of the image carrier corresponding to a tip position of the printing member has reached the transfer position, and the timing of the switching operation controlled by the control means in the first mode occurs later in the image forming operation than timing of the switching operation controlled by the control means in the second mode.

21. The image forming apparatus in any one of claims 18 through 20, wherein the control means controls the voltage application means so as to apply a bias voltage to the transfer member at the transfer position during a non-transferring time to detect a resistance value at the transfer position.

22. The image forming apparatus of claim 21, wherein the control means controls the voltage application means so as to set the second voltage according to a detected resistance value.

23. The image forming apparatus of claim 21, wherein an operating environment in a main body of the apparatus is detected based on a detected resistance value.

24. The image forming apparatus of claim 23, wherein the mode is selected according to the detected operating environment.

25. The image forming apparatus of claim 21, wherein the mode is selected and the second voltage is set according to a detected resistance value.

26. The image forming apparatus in any one of claims 18 through 20, wherein the mode is selected according to a type of the printing member.

27. The image forming apparatus in any one of claims 1, 9, and, 18, wherein the first value voltage in the first mode is different from the first voltage value in the second mode.

28. The image forming apparatus in any one of claims 1, 9, and 18, wherein the second voltage value in the first mode is different from the second voltage value in the second mode.

* * * * *

UNITED STATES PATENT AND TRADEMARK OFFICE

CERTIFICATE OF CORRECTION

PATENT NO. : 6,859,631 B2
DATED : February 22, 2005
INVENTOR(S) : Masahiko Suzmi et al.

It is certified that error appears in the above-identified patent and that said Letters Patent is hereby corrected as shown below:

Column 6,
Line 23, “sur face” should read -- surface --.

Column 8,
Line 55, “current a,” should read -- current Ia, --.

Column 9,
Line 63, “a a” should read -- a --.

Column 13,
Line 51, “environment” should read -- environment. --.

Column 17,
Line 51, “based” should read -- based on --.

Column 18,
Line 13, “mens” should read -- means --.

Column 19,
Line 25, “reached” should read -- reached to --.

Signed and Sealed this

Fifth Day of July, 2005

JON W. DUDAS
*Director of the United States Patent and Trademark Office*